US005123642A

United States Patent [19]

Stokes

[11] Patent Number: 5,123,642

[45] Date of Patent: Jun. 23, 1992

[54] NET ATTACHMENT FOR BASKETBALL HOOP

[76] Inventor: Mark A. Stokes, 2009-B C St. SE., Auburn, Wash. 98002

[21] Appl. No.: 785,538

[22] Filed: Oct. 31, 1991

[51] Int. Cl.[5] ..... A63B 63/08

[52] U.S. Cl. ..... 273/1.5 R

[58] Field of Search ..... 273/1.5 R, 1.5 A

[56] References Cited

U.S. PATENT DOCUMENTS

| | | | |
|---|---|---|---|
| 1,544,453 | 6/1925 | Harbison | 273/1.5 R |
| 2,694,572 | 11/1954 | Crisp | 273/1.5 A |
| 3,085,800 | 4/1963 | Holstad | 273/1.5 A |
| 3,105,683 | 10/1963 | Kimbrell | 273/1.5 A |
| 3,160,414 | 12/1964 | Gray | 273/1.5 A |
| 3,446,504 | 5/1969 | Pascucci | 273/1.5 A |
| 4,353,548 | 10/1982 | Mahoney | 273/1.5 R |
| 4,579,339 | 4/1986 | Grimm | 273/1.5 A |
| 4,805,903 | 2/1989 | McArdle | 273/1.5 R |
| 4,903,964 | 2/1990 | Anderson | 273/1.5 R |
| 4,905,995 | 3/1990 | Apo | 273/1.5 R |

*Primary Examiner*—Paul E. Shapiro

*Attorney, Agent, or Firm*—Joan H. Pauly

[57] ABSTRACT

A plurality of circumferentially spaced hooks (32, 36) extend upwardly from a ring (14) to which netting (18) is attached. A pair of retaining devices (40) are carried by the ring (14) and are circumferentially spaced from each other and from the hooks (32, 36). One of the hooks (32) may be pivotable to aid in installing and removing the attachment (12). The retaining devices (40) comprise a coil torsion spring (52) from which an integral latch member (54) extends. The member (54) terminates in a cradle (58) that is biased to pivot upwardly into engagement with the lower surface of the hoop (2). In an alternate embodiment, each retaining device (72) includes a flat spring (74) that bends radially inwardly and is biased radially outwardly to urge a hard rubber engagement portion (76) against the hoop (2). The attachment (12, 12') may be provided in combination with an installation pole (60, 82). The pole (60) engages the pivotal hook housing (28) to pivot the hook (32). The pole (82) engages the retaining devices (72) to bend them radially inwardly.

17 Claims, 7 Drawing Sheets

Fig. 5
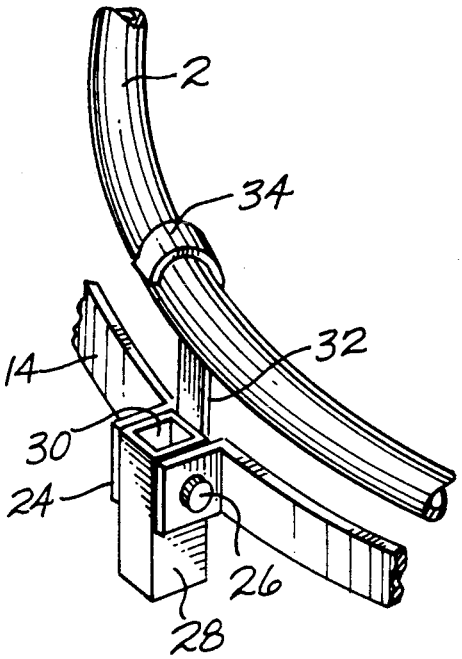
Fig. 6
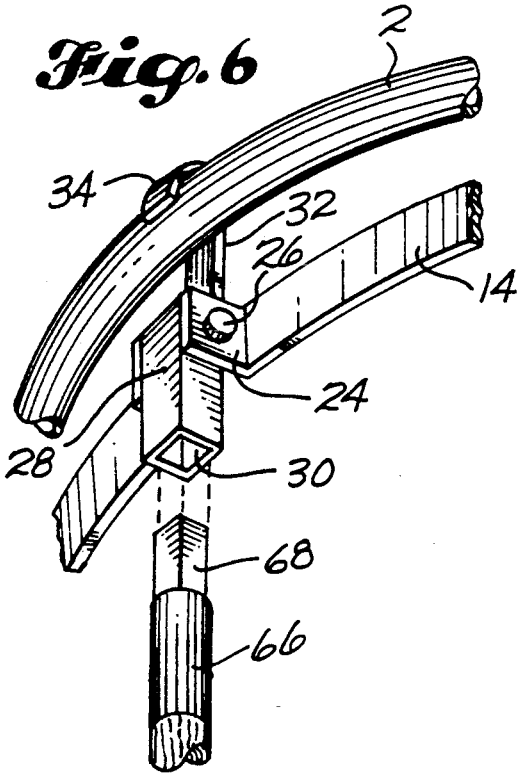
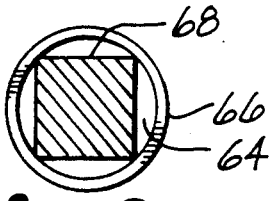
Fig. 9
Fig. 8
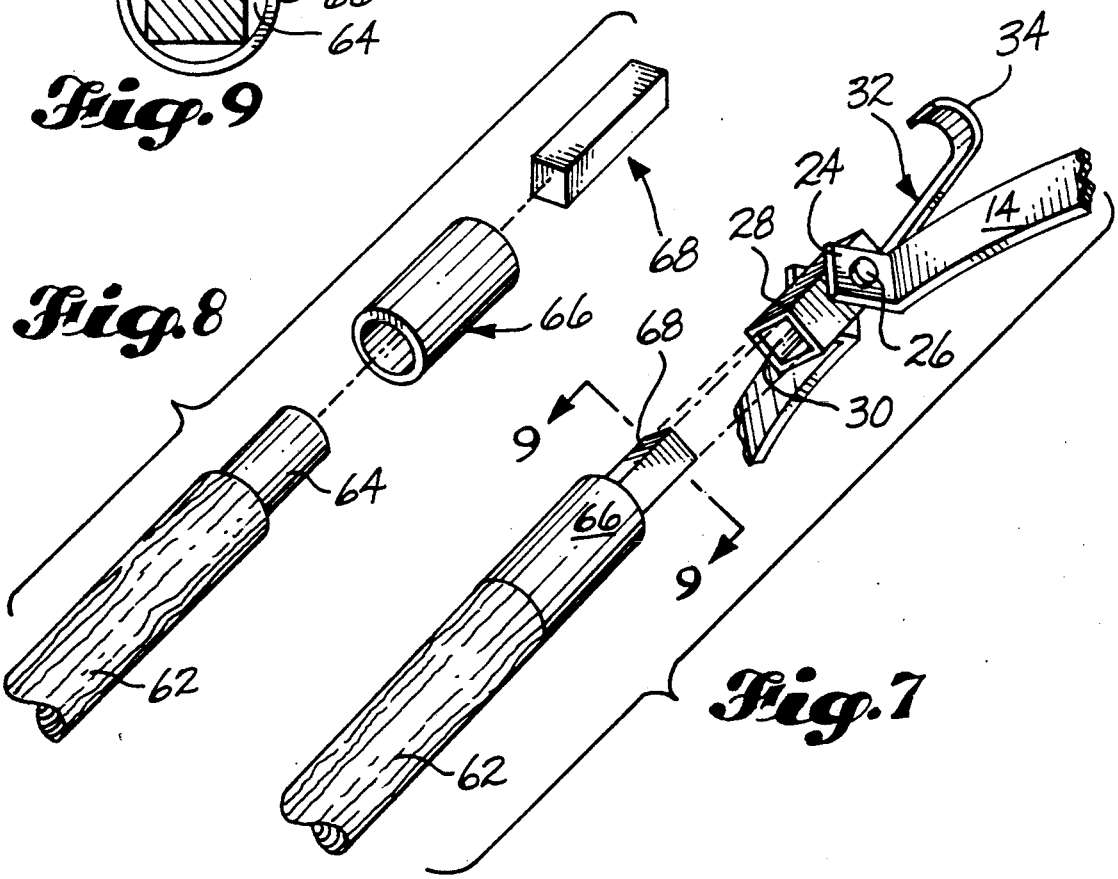
Fig. 7

NET ATTACHMENT FOR BASKETBALL HOOP

TECHNICAL FIELD

This invention relates to attachments for basketball hoops and, more particularly, to such an attachment which includes a ring that carries a plurality of circumferentially spaced hooks positionable over the hoop, and a plurality of retaining devices spaced from each other and from the hooks and positioned to engage lower portions of the hoop to urge it upwardly into firm engagement with the hooks.

BACKGROUND INFORMATION

A common problem associated with basketball courts in public locations, such as school yards, parks, and playgrounds, is the absence of nets on the basketball hoops. The nets may be absent because they have been removed by vandals or may simply not be provided because of the vulnerability to vandalism. The applicant is aware of previously proposed attachments for basketball hoops, some of which have nets attached thereto. The known attachment designs do not provide an adequate solution to the problem of the absence of nets in public basketball courts because the attachments tend to be relatively complicated in structure and expensive to manufacture and/or relatively difficult to install on and remove from a hoop.

DISCLOSURE OF THE INVENTION

The subject of the invention is an attachment for a basketball hoop. According to a basic aspect of the invention, the attachment comprises a ring, a plurality of circumferentially spaced hooks, and a plurality of retaining devices. The hooks are carried by and extend upwardly from the ring and are positioned to hook over the hoop. The retaining devices are carried by the ring and are circumferentially spaced from each other and from the hooks. Each retaining device has an engagement surface that is biased into a position in which it engages a lower portion of the hoop, when the hooks are positioned over the hoop, to urge the hoop upwardly into firm engagement with the hooks and resist upward and rotational movement of the ring relative to the hoop. The attachment preferably has a net attached to and hanging downwardly from the ring. The attachment may also have other structures, such as practice-related structures depending downwardly from the ring instead of, or in addition to the net.

In a preferred embodiment of the attachment, each retaining device comprises a latch member having an inner end portion pivotally attached to the ring, and an outer end portion that includes the engagement surface. The latch member extends substantially tangentially to the ring and is biased to pivot the outer end portion upwardly into engagement with the lower portion of the hoop. A preferred feature of this embodiment is an outer end portion of the latch member that curves downwardly and radially to form a cradle that engages the lower portion of the hoop. Another preferred feature of the embodiment is a latch member that is formed by an integral continuation of a torsion spring which is secured to the ring.

In each embodiment of the invention, one of the hooks may be a pivotal hook that has a lower end portion pivotally mounted on the ring to permit the upper end portion of the hook to pivot radially inwardly relative to the ring. The feature of the pivotal hook may advantageously be provided in combination with a pole for easily installing the attachment on a hoop and removing it therefrom. The pole is elongated and has an actuating end and an opposite handle end. Preferably, the attachment comprises a housing which is pivotally mounted on the ring and to which the pivotal hook is attached. The housing defines a socket shaped to receive the actuating end of the pole to enable an operator grasping the handle end to remotely pivot the pivotal hook. The structural and functional interrelationship of the pivotal hook and the pole makes it possible to install and remove the attachment quickly and easily. During the installation or removal, the pole need not contact any elements carried by the ring other than the pivot housing. Therefore, a great variety of structures may be mounted on the ring, and the risk of entanglement or damage to a net or other structure is virtually eliminated.

In a second preferred embodiment of the attachment, each retaining device includes a flexible portion that is bendable in a radially inward direction and biased radially outwardly to urge the engagement surface against the hoop. When the attachment is to be used with a hoop that has a rounded cross section, the flexible portion preferably comprises a flat spring having a lower end portion secured to the ring. Each retaining device includes an engagement portion on which the engagement surface is formed and which is carried by the upper end portion of the flat spring. The engagement surface is rounded to conform to the hoop cross section.

Like the first preferred embodiment, the second preferred embodiment may advantageously be provided in combination with an elongated pole having a handle end and an opposite actuating end. The actuating end preferably has a plurality of fingers positioned to contact the retaining devices to bend the retaining devices out of engagement with the hoop. In attachments that have the type of engagement portions described above, the fingers preferably contact the engagement portions to bend the retaining devices out of engagement with the hoop.

The attachment of the invention solves the basic problem of the lack of nets on hoops in public basketball courts and also avoids the kinds of problems that are associated with known types of attachments. The attachment of the invention has a relatively simple structure and may be easily and economically manufactured. The structure of the attachment also provides a reliable connection to the hoop so that the attachment is not displaced during play and, therefore, does not interfere with the play. The attachment of the invention is very durable and may be used many times over a period of Years without losing its effectiveness. One of the most significant advantages of the invention is the ease with which the attachment may be installed on or removed from a basketball hoop.

These and other advantages and features will become apparent from the detailed description of the best modes for carrying out the invention that follows.

BRIEF DESCRIPTION OF THE DRAWINGS

In the drawings, like element designations refer to like parts throughout, and:

FIG. 5 is a pictorial view of a portion of the hoop and attachment shown in FIG. 2, illustrating the engagement of the hoop by the pivotal hook.

FIG. 6 is a partially exploded pictorial view looking upwardly at the hoop and attachment portions shown in FIG. 5 and illustrating the relationship between the elongated pole and the pivotal hook housing.

FIG. 7 is a partially exploded pictorial view of the elements shown in FIG. 6, and illustrating the pivotal hook in its radially inward position.

FIG. 8 is an exploded pictorial view of the preferred embodiment of the elongated pole for use with the attachment shown in FIGS. 1 and 2.

FIG. 9 is a sectional view taken along the line 9—9 in FIG. 7.

BEST MODES FOR CARRYING OUT THE INVENTION

The drawings illustrate the best modes of the apparatus of the invention currently known to the applicant. The illustrated apparatus includes two attachments 12, 12' and their associated installation poles 60, 82. The attachments 12, 12' are designed for use on standard basketball hoop structures, such as that shown in FIGS. 2, 3, and 4. However, the attachments 12, 12' and other embodiments of the attachment of the invention may be used, with modifications, if necessary, on other nonstandard hoop structures without departing from the spirit and scope of the invention.

Figure 2:
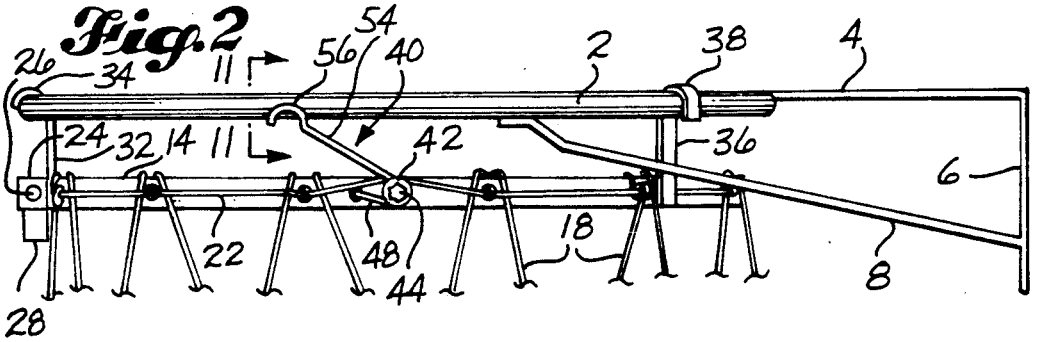
FIG. 2 is a side elevational view of the attachment shown in FIG. 1 installed on a basketball hoop.
Figure 2A:
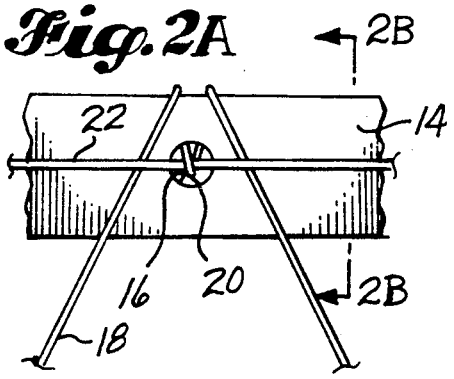
FIG. 2A is a fragmentary elevational view of a portion of the ring shown in FIG. 2, illustrating the attachment of the netting to the ring.
Figure 3:
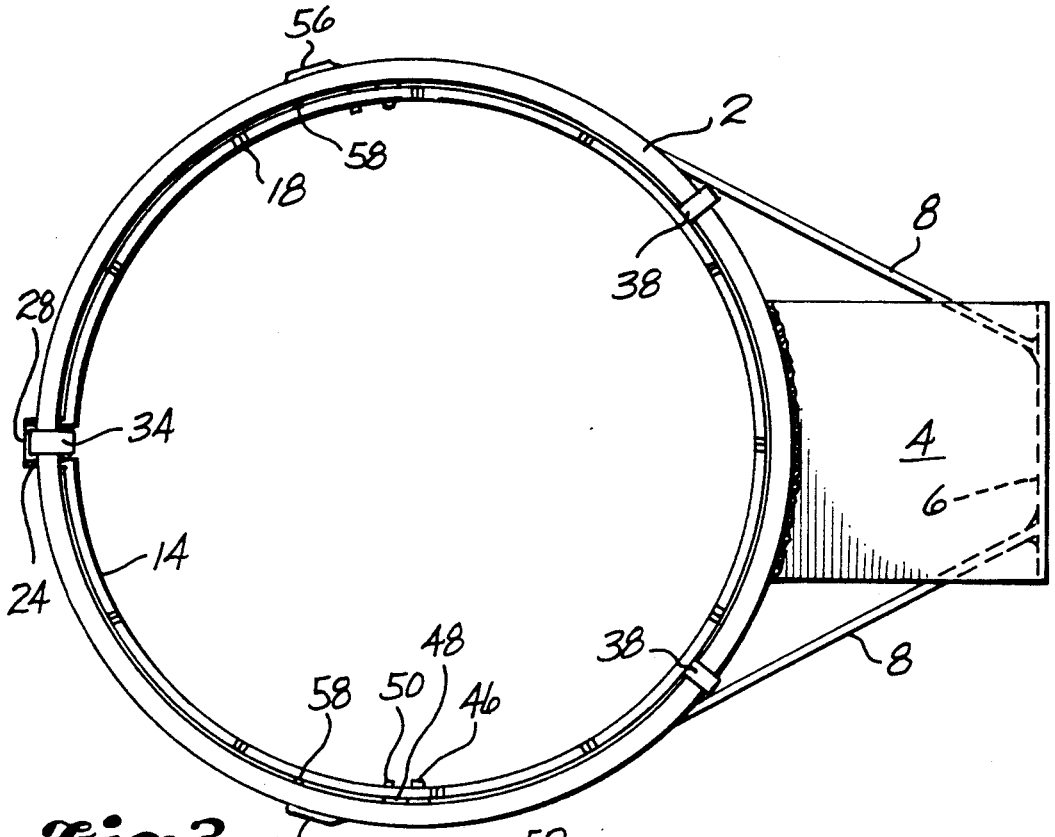
FIG. 3 is a top plan view of the attachment and hoop shown in FIG. 2.
Figure 4:
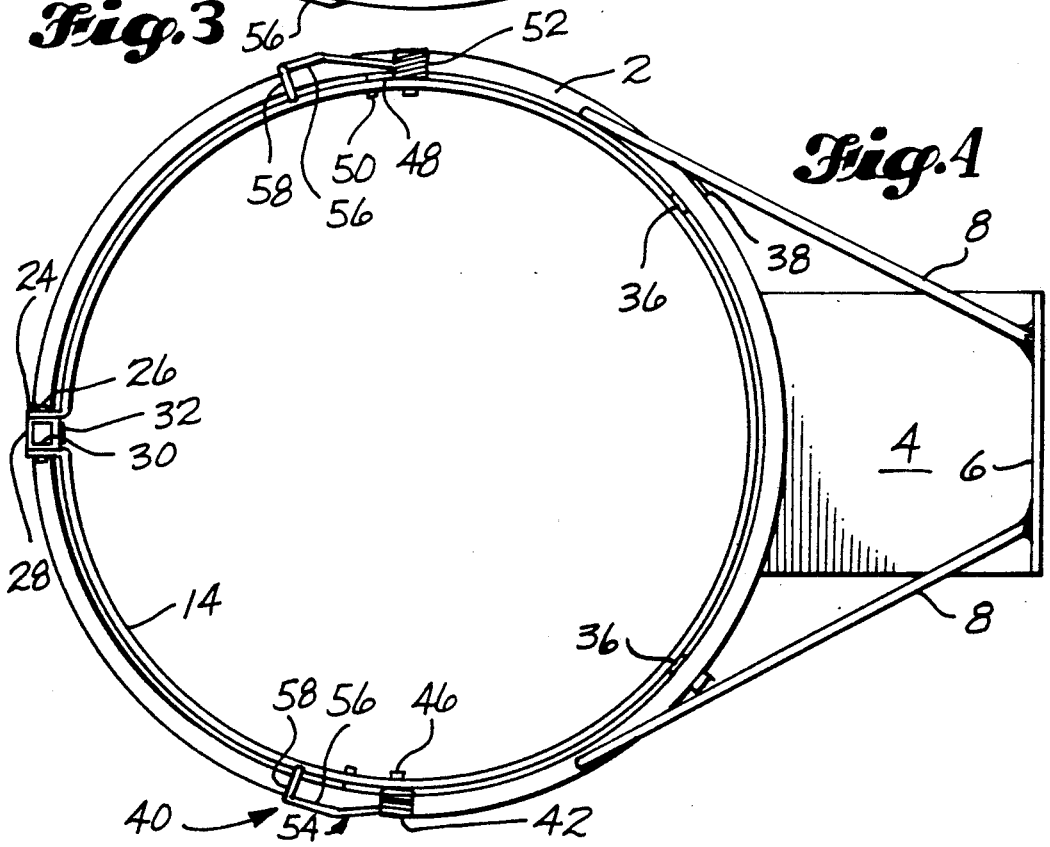
FIG. 4 is a bottom plan view of the attachment and hoop shown in FIG. 2, with the netting omitted.
Figure 11:
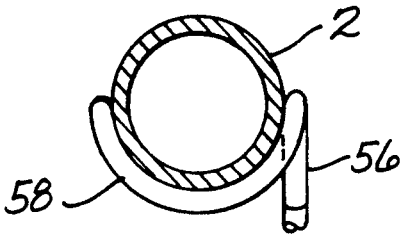
FIG. 11 is a sectional view taken along the line 11—11 in FIG. 2.

FIGS. 2, 3, and 4 illustrate a typical form of a standard hoop structure. The structure includes a circular hoop 2 with a round cross section (FIG. 11). The hoop 2 is attachable to a support structure, such as a wall, by means of an L-shaped bracket 4, 6. The bracket 4, 6 includes a top plate 4 that is permanently secured to the hoop 2, such as by welding, and a back plate 6. Diagonal braces 8 extend from the back plate 6 to the hoop 2 to provide further support.

Figure 1:
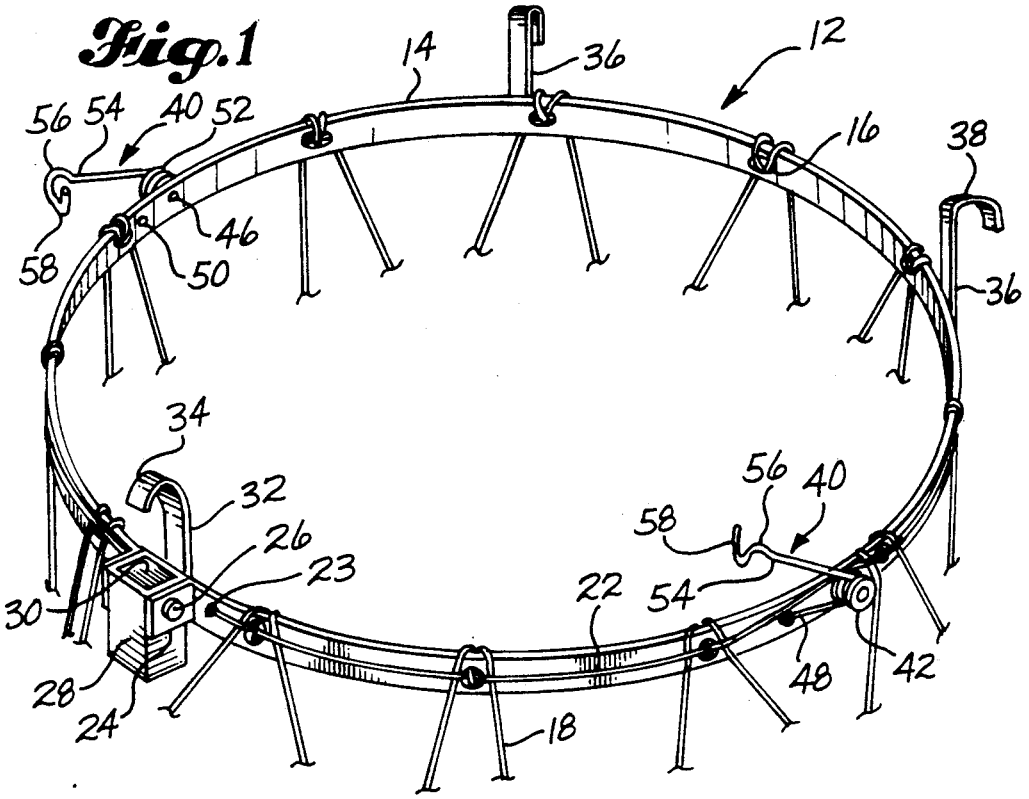
FIG. 1 is a pictorial view of a first preferred embodiment of the attachment of the invention.
Figure 2B:
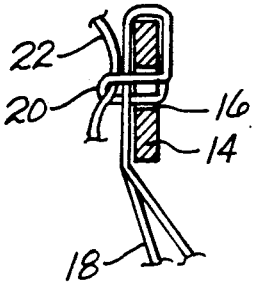
FIG. 2B is a sectional view taken along the line 2B—2B in FIG. 2A.

The structure and use of a first preferred embodiment of the attachment 12 are illustrated in FIGS. 1-11. This embodiment 12 is currently the most preferred embodiment. The overall structure of the attachment 12 can best be seen in FIGS. 1, 2, 3, and 4. The attachment 12 includes a ring 14, which has a substantially rectangular cross section, as shown in FIG. 2B. The ring 14 preferably has a diameter that is smaller than the diameter of the hoop 2. As can be seen in FIGS. 3 and 4, in the first preferred embodiment, the outer diameter of the ring 14 is slightly smaller than the inner diameter of the hoop 2.

As noted above, the primary purpose of the attachment of the invention is to provide a removable net for playground and other public basketball hoops. Each of the illustrated preferred embodiments includes a net. Referring to FIGS. 1, 2, 2A, and 2B, in the preferred embodiment 12, the ring 14 is provided with a plurality of apertures 16 for attaching netting 18 to the ring 14. The manner in which the netting 18 is attached to the ring 14 can best be seen in FIGS. 2A and 2B. The upper edge of the netting 18 is formed by a plurality of loops 20, each of which extends up along the outer circumferential surface of the ring 14, over the top of the ring 14, and part way down the inner circumferential surface of the ring 14 to an aperture 16. Each loop 20 extends radially outwardly through its corresponding aperture 16 and is held in place by a tie strap 22 which extends around the outer circumferential surface of the ring 14. In the embodiment of FIGS. 1-11, the outer circumferential ring surface is interrupted by a pivotal hook housing 28. Therefore, the ends of the tie strap 22 preferably terminate adjacent to the housing 28 and are secured to the ring 14. This can be accomplished by extending the tie strap end through an aperture 23 (FIG. 1) and tying a knot on the tie strap end inside the ring 14 to prevent it from being pulled back out through the aperture 23.

The attachment 12 includes a plurality of hooks 32, 36 and a plurality of retaining devices 40 for securely mounting the attachment 12 onto the hoop 2. The arrangement of the hooks 32, 36 and retaining devices 40 is illustrated in FIGS. 1, 2, 3, and 4. There are two fixed hooks 36 positioned approximately 80° apart. Each of these hooks 36 has a lower portion that is permanently secured to the outer circumferential surface of the ring 14, such as by welding. Each hook 36 extends upwardly from the ring 14 and terminates in an upper radially outwardly curving portion 38 that hooks over the hoop 2. The attachment 12 is preferably mounted on the hoop 2 with the two fixed hooks 36 positioned adjacent to the inner edges of the opposite diagonal braces 8, as illustrated in FIGS. 3 and 4.

In addition to the two fixed hooks 36, the attachment 12 has a third pivotal hook 32. The hook 32 is positioned diametrically opposite the midpoint of the arc between the two fixed hooks 36. To accommodate the mounting of the pivotal hook 32, the ring 14 has a circumferential gap bounded by a pair of radial mounting projections 24. A pivot housing 28 is pivotally mounted on the ring 14 between the projections 24 by a pivot pin 26, as best seen in FIGS. 1, 5, and 6. A lower portion of the pivotal hook 32 is permanently secured to the inner circumferential surface of the housing 28. The hook 32 extends upwardly from the housing 28 and terminates in a curved upper portion 34 that is positioned similarly to the upper portions 38 of the fixed hooks 36 to hook over the hoop 2. The housing 38 is formed from hollow square metal tubing and has a socket opening 30 extending vertically therethrough. The lower portion of the socket 30 receives the actuating end of a pole to pivot the hook 32, as described further below and illustrated in FIGS. 6 and 7.

When the attachment 12 is mounted on a hoop 2, it is supported by the hooks 32, 36 and hangs downwardly from the hoop 2, as shown in FIG. 2. The retaining devices 40 engage lower portions of the hoop 2 to exert an upward force on the hoop 2 and, thereby, prevent upward displacement of the attachment 12 relative to the hoop 2. The retaining devices 40 also resist rotational movement of the attachment 12 relative to the hoop 2. In accordance with the invention, the attachment has a plurality of retaining devices that are carried by the ring and are circumferentially spaced from each other and from the hooks. In the preferred embodiment illustrated in FIGS. 1-11, there are two retaining devices 40 that are positioned substantially diametrically opposite each other, with each device 40 being spaced from the pivotal hook 32 about 90°. Each device 40 has an engagement surface that is biased into a position in which it engages and is urged against a lower portion of the hoop 2.

The structure of the retaining devices 40 is illustrated in FIGS. 1, 2, 3, 4, and 11. The two devices 40 are mirror images of each other. Each device 40 comprises a torsion spring of the type used in cap guns and clothespins. The spring has a coil portion 52 and a latch portion 54 Which is a tangential integral continuation of the coil 52. The coil 52 is mounted onto the outer circumferential surface of the ring 14 by means of a fastener 42. The fastener 42 has a radially outer head with a hexagonal slot 44 and an inner threaded end 46 which threadedly engages the ring 14. The coil 52 has an anchor leg 48 opposite the latch member 54. The leg 48 extends tangentially from the coil 52 and has a radially extending anchor end 50 that is received into a suitable opening in the ring 14 to anchor the coil 52.

The latch member 54 extends from the coil 52 upwardly and substantially tangentially to the outer circumferential surface of the ring 14. The term "substantially tangentially" is intended to mean that, although the main portion of the latch member 54 is spaced radially outwardly from the outer circumferential surface of the ring 14, it extends in a direction substantially parallel to a tangent to such surface. The outer end portion of the latch member 54 opposite the coil 52 curves upwardly and then downwardly and radially inwardly to form a generally semicircular arc 56. Outwardly of the arc 56, the outer end portion continues to curve radially inwardly and then upwardly to form, with the downward portion of the arc 56, a cradle 58. The cradle 58 defines an arcuate engagement surface that is urged against a lower surface portion of the hoop 2, as best seen in FIGS. 2 and 11.

The attachment 12 is designed to be installed on and removed from a hoop 2 using a pole that engages the socket 30 of the pivotal housing 28. The preferred embodiment of the pole 60 is illustrated in FIGS. 6-9. The pole 60 has an elongated cylindrical handle end 62 that is preferably made of wood. The upper portion 64 of the handle 62 has a reduced diameter. A tubular metal sleeve 66 is received over the reduced diameter handle portion 64. The length of the sleeve 66 is greater than the length of the reduced diameter portion 64 so that the sleeve 66 projects outwardly from the handle 62. A piece 68 of solid square stock metal is received into the outer end of the sleeve 66 and bottoms out on the outer radial surface of the reduced diameter handle portion 64. As can be seen in FIG. 9, the square end piece 68 is dimensioned to fit snugly within the sleeve 66. Preferably, the engagement of the end piece 68 in the sleeve 66 is further secured by welding around the outer radial surface of the sleeve 66. The welding can also be used to fill in the spaces between the sides of the end piece 68 and the outer rim of the sleeve 66 to give the pole 60 a more finished appearance. The end piece 68 is dimensioned to be received into the socket 30 defined by the pivotal housing 28, as illustrated in FIGS. 6 and 7. Engagement of the piece 68 in the socket 30 enables a person standing on the ground to easily remove the attachment 12 from a hoop 2 or to lift the attachment 12 up into engagement with the hoop 2.

Figure 10A:
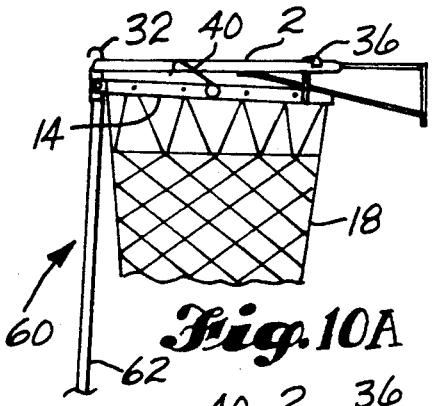
FIGS. 10A-10F are a series of elevational views illustrating the removal of the attachment shown in FIGS. 1 and 2 from a basketball hoop.
Figure 10B:
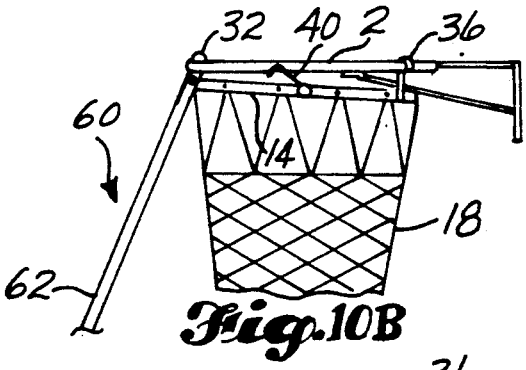
Figure 10C:
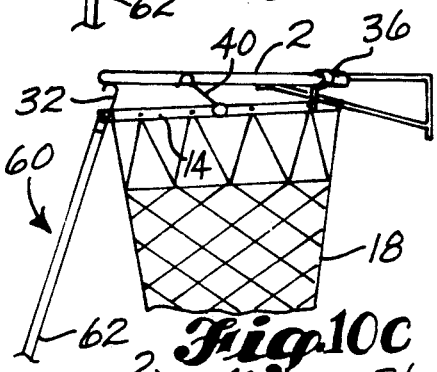
Figure 10D:
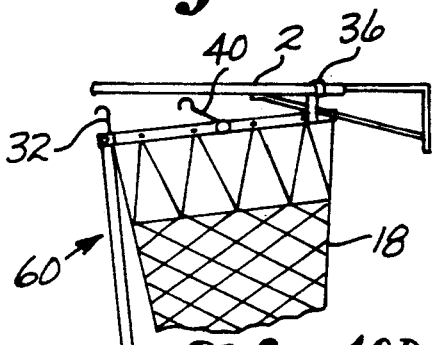
Figure 10E:
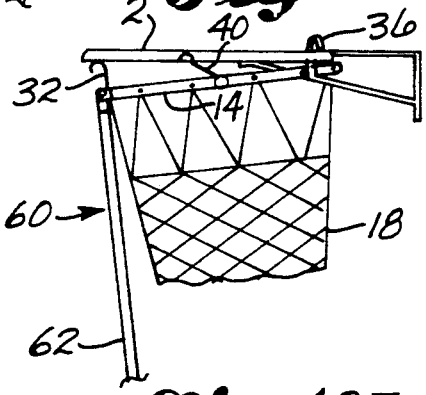
Figure 10F:
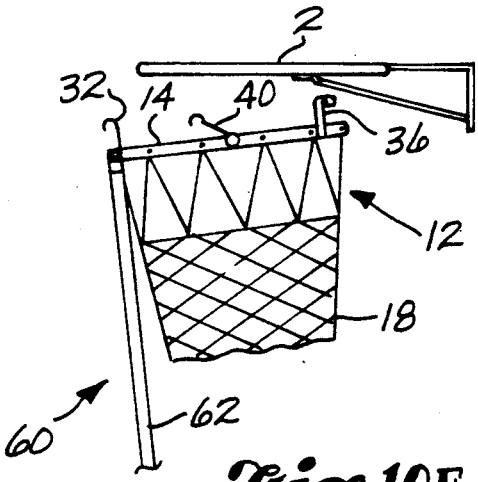

The removal of the attachment 12 from a hoop 2 is illustrated in FIGS. 10A-10F. Referring to FIG. 10A, a person standing on the ground grasps the handle end 62 of the pole 60, inserts the actuating end (end piece 68) into the socket 30, and pushes upwardly to disengage the hook 32 from the hoop 2. The pole 60 is then pivoted, as illustrated in FIG. 10B, to pivot the pivotal hook 32 radially inwardly. This allows the portion of the attachment 12 around the hook 32 to be moved downwardly relative to the hoop 2, as shown in FIG. 10C. As this portion of the attachment 12 is moved downwardly, the compression of the spring coils 52 by engagement of the latch members 54 against the under surface of the hoop 2 is relieved. When the spring pressure is fully relieved, the latch members 54 move out of engagement with the hoop 2, as shown in FIG. 10D. After the pivotal hook 32 has been disengaged from the hoop 2 and as the latch members 40 are being brought out of engagement, the pole 60 is preferably pivoted back into its initial position, as shown in FIG. 10D. When the pivotal hook 32 has been disengaged and the spring pressure relieved, the pole 60 is moved to lift the fixed hooks 36 up off the hoop 2, as shown in FIG. 10E. During the disengagement of the hooks 36, the retaining devices 40 may come back into contact with the hoop 2, but such contact is preferably minimal with little, if any, pressure so that the force of the coil springs 52 does not impede the removal procedure. Once the hooks 36 have been disengaged, the entire attachment 12 may be moved away from the hoop 2, as illustrated in FIG. 10F.

The installation procedure is the same as the removal procedure except that the steps are performed in reverse order. First, the fixed hooks 36 are engaged up over the hoop 2. Then, the latch members 54 are brought into contact with the hoop 2, and the pole 60 is pivoted to pivot the pivotal hook 32. As the pivoted hook 32 is moved upwardly, the hoop 2 pushes downwardly on the latch members 54 against the force of the spring coils 52. When the pivot housing 28 has been raised to a position in which the hook 32 can be engaged over the hoop 2, the pole 60 is pivoted to its upright position. Then, the relative upward force on the hoop 2 and downward force on the ring 14 resulting from the pivoting of the latch members 54 and storing of spring energy in the coils 52 urge the hoop 2 into firm engagement with the hooks 32, 36. The resulting fully installed position of the attachment 12 is shown in FIG. 2. Once the attachment 12 is in this position, the pole 60 is simply lowered to disengage the actuating end 68 from the socket 30 and the retaining devices 40 hold the attachment 12 in position until the removal procedure is carried out.

Figure 12:
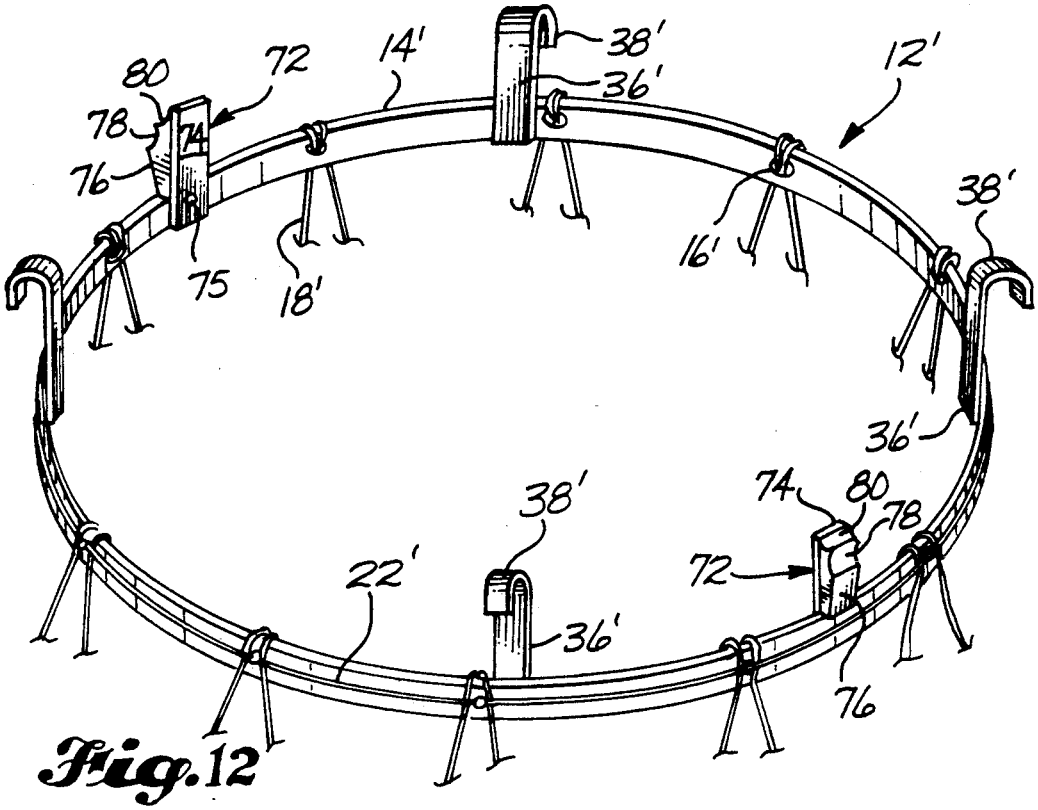
FIG. 12 is similar to FIG. 1 except that it shows a second preferred embodiment of the attachment.
Figure 13:
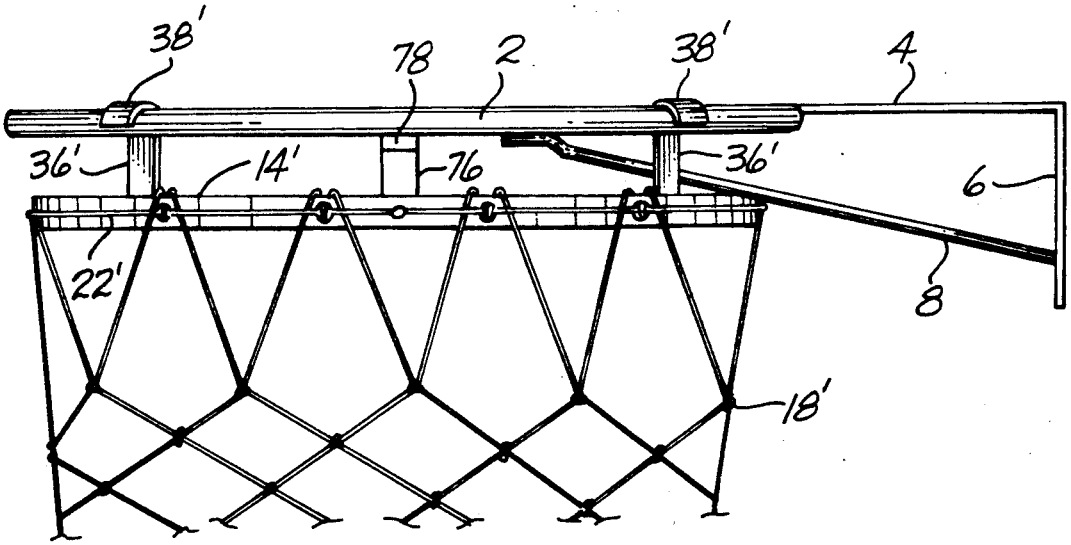
FIG. 13 is an elevational view of the attachment shown in FIG. 12 installed on a hoop.
Figure 14:
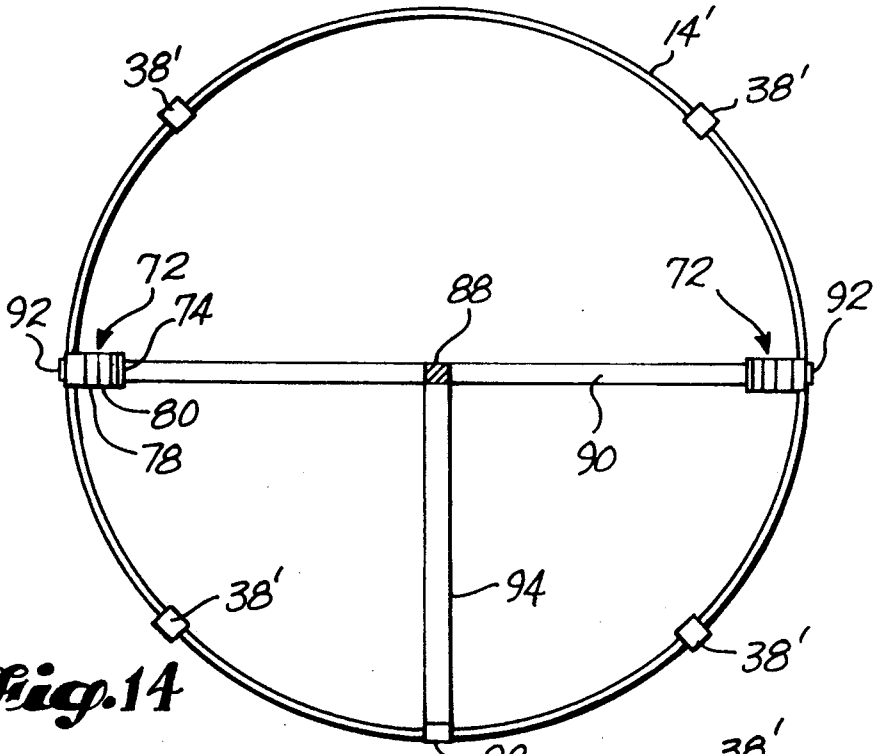
FIG. 14 is a top plan view of the attachment shown in FIGS. 12 and 13 secured to an elongated pole for installation on a hoop, with a portion of the pole shown in section.

A second embodiment of the invention is illustrated in FIGS. 12–17. Like the first embodiment, this embodiment 12' includes a circular ring 14' having apertures 16' to which netting 18' is attached by means of a tie strap 22'. The attachment 12' has four fixed hooks 36' with upper curved portions 38' that hook over a basketball hoop 2, as shown in FIG. 13. The hooks 36' are spaced at 90° intervals around the ring 14', as can be seen in FIGS. 12 and 14. The lower portions of the hooks 36' are shown secured to the inner circumferential surface of the ring 14', but could also be secured to the outer circumferential surface. Since this embodiment 12' does not have a pivotal hook, the ring 14' is continuous.

The attachment 12' includes two retaining devices 72 positioned diametrically opposite each other, with each device 72 being located midway between two of the hooks 36'. Each of the devices 72 comprises a flexible spring portion 74 made from flat steel spring stock. The lower portion of the flat spring 74 is permanently secured to the inner circumferential surface of the ring 14', such as by a bolt 75. Its upper portion extends upwardly from the ring 14' and carries a hard rubber engagement portion 76. In the relaxed state of the retaining device 72 shown in FIG. 12, the engagement portion 76 extends upwardly and radially outwardly over the top edge of the ring 14'. The upper portion of the engagement member 76 has a semi-cylindrical cam surface 78 formed thereon and an adjacent curved engagement surface 80. The flexibility of the spring 74 allows the retaining device 72 to bend radially inwardly into the installation and removal position shown in FIG. 15. The device 72 bends against the force of the spring 74, which biases the device 72 toward the radially outward position shown in FIG. 12. The curved engagement surface 80 is configured to conform to the curved outer surface of the hoop 2, which has a circular cross section, to provide a firm engagement of the surface 80 against the lower portion of the hoop 2.

Figure 16:
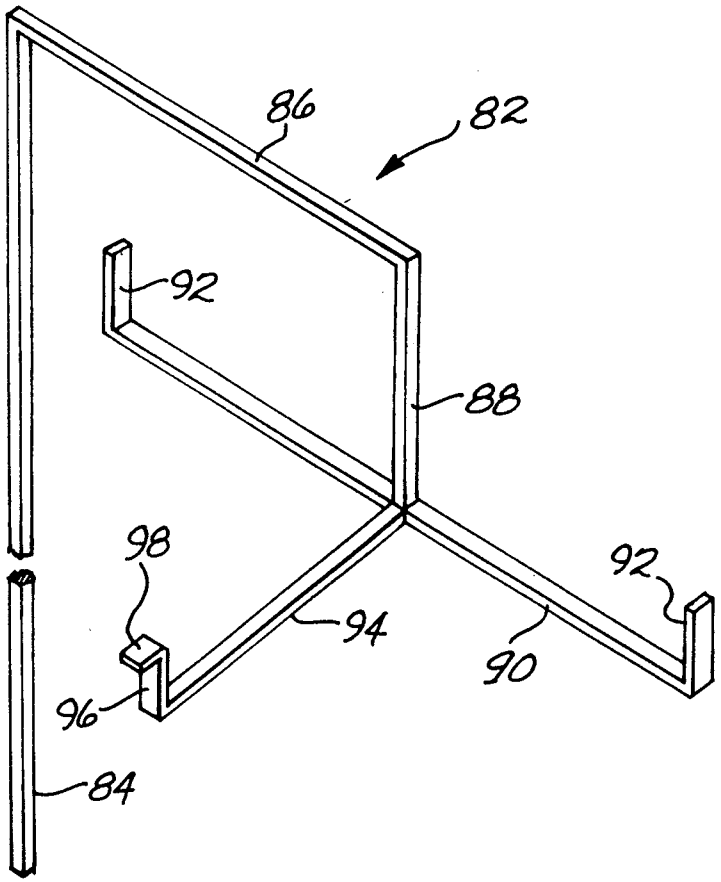
FIG. 16 is a pictorial view of the installation pole shown in FIGS. 14 and 15.
Figure 15:
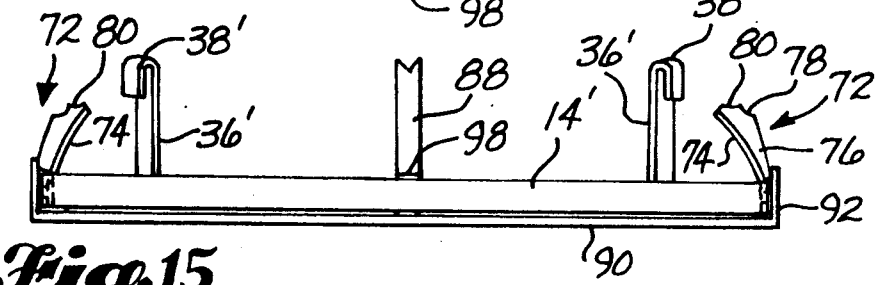
FIG. 15 is an elevational view of the attachment and installation pole shown in FIG. 14.

Both the first embodiment 12 and the second embodiment 12' are preferably provided in combination with an installation pole. The structure of the pole 82 designed for use with the attachment 12' is best seen in FIG. 16. The pole 82 includes an elongated handle end 84 and an upper actuating portion. As shown, the handle 84 has a square cross section. It could also have a round cross section like the handle 62 of the pole 60 shown in FIGS. 6–8. The upper actuating portion of the pole 82 includes a horizontal arm 86 that extends perpendicular to 10 the handle 84 and terminates in a downwardly extending vertical leg 88. A horizontal actuating bar 90 is secured to the lower end of the vertical leg 88. The bar 90 extends parallel to the upper horizontal arm 86. An upwardly extending actuating finger 92 is carried by each of the opposite ends of the bar 90. The fingers 92 are positioned to engage the retaining devices 72 to bend them radially inwardly, as illustrated in FIG. 15. The pole 82 also includes a guide bar 94 extending horizontally at right angles to the actuating bar 90. The guide bar 94 terminates in an L-shaped end portion 96 with an upper horizontal lip 98 that is positioned to extend over the c upper edge of the ring 14' to help guide the positioning of the actuating bar 90 relative to the attachment 12'.

In order to install the attachment 12' on a hoop 2, the pole 82 and attachment 12' are tilted relative to each other to position the guide bar 94 into a guide position in which the lip 98 extends over the top edge of the ring 14'. With the guide bar 94 in place, the attachment 12' and pole 82 are maneuvered to bring the fingers 92 into engagement with the hard rubber portions 76 of the retaining devices 72 to bend the devices 72 radially inwardly into the position shown in FIG. 15. The combination of the guide member 96 and the spring force of the retaining devices 72 against the fingers 92 holds the attachment 12' securely on the actuating end of the pole 82.

Figure 17A:
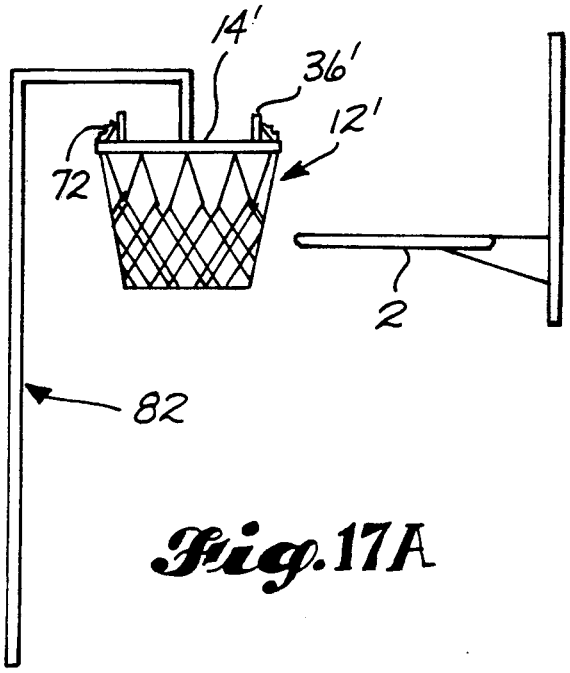
FIGS. 17A—17D are a series of elevational views illustrating the installation of the attachment shown in FIGS. 12-15 onto a hoop.
Figure 17B:
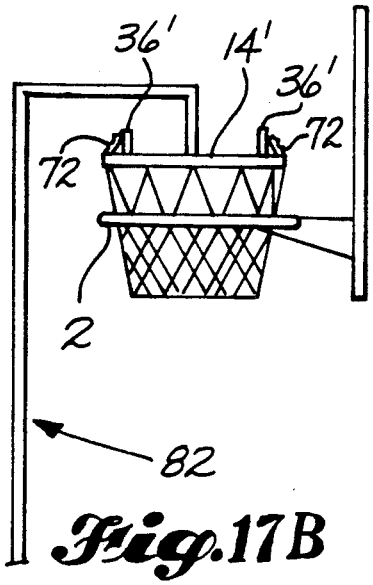
Figure 17C:
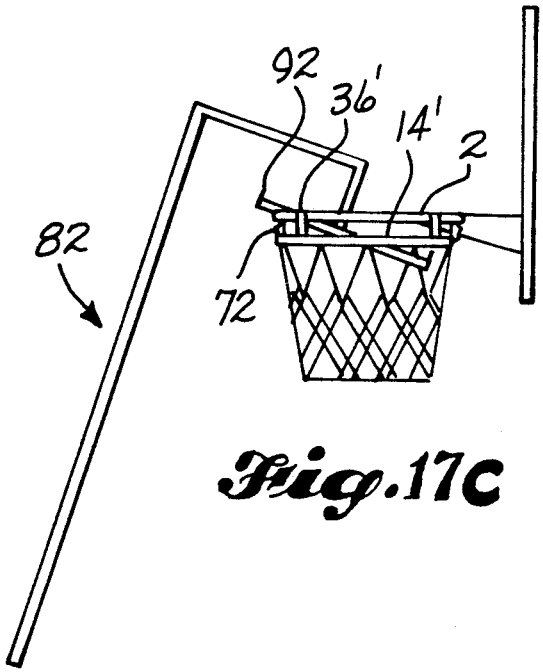
Figure 17D:
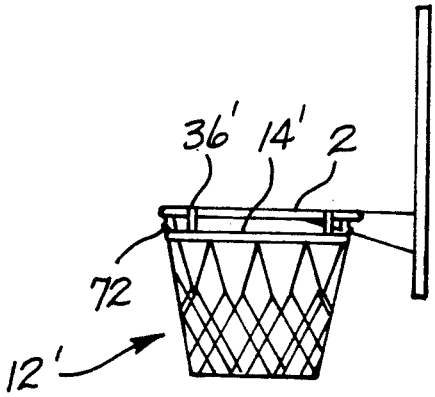

Once the attachment 12' is securely placed on the pole 82, the attachment 12' may be installed on the hoop 2 as illustrated in FIGS. 17A–17D. The pole 82 is maneuvered to lift the attachment 12' up, as shown in FIG. 17A, and then over the hoop 2. Then, the attachment 12' is lowered down through the hoop 2, as shown in FIG. 17B. The lowering of the attachment 12' brings the upper portions 38, of the hooks 36' down over and into an engagement with the top of the hoop 2. With the hooks 36' engaged, the downward movement of the pole 82 is continued to release the fingers 92 from engagement with the retaining devices 72. When the fingers 92 disengage, the springs 74 move the devices 72 radially outwardly and urge the engagement surfaces 80 against lower surface portions of the hoop 2. The cam surfaces 78 help guide the engagement surfaces 80 into position. As in the first embodiment, the force of the engagement surfaces against the hoop 2 urges the hoop 2 into firm engagement with the hooks to resist upward movement of the attachment 12' relative to the hoop 2 and relative rotational movement. When the attachment 12' has been secured to the hoop 2, the pole 82 is tilted, as shown in FIG. 17C, to allow it to be raised upwardly through the hoop 2 and then away from the hoop 2. FIG. 17D illustrates the installed attachment 12' following the completion of the installation procedure.

The removal procedure is the reverse of the installation procedure. The actuating bar 90 and guide bar 94 of the pole 82 are moved downwardly through the hoop 2 and attachment ring 14' to position the pole 82 for engaging the attachment 12'. The downward movement is made possible by tilting the pole 82, as shown in FIG. 17C. Then, the pole 82 is straightened to an upright position and is moved upwardly to cause the fingers 92 to engage the retaining devices 72 and bend them radially inwardly, as shown in FIG. 15. Then, the complete removal of the attachment 12' requires only a continuation of the upward movement of the pole 82.

In both of the illustrated embodiments, the combination of the hooks and retaining devices provides a secure connection between the hoop 2 and the attachment. This secure connection is achieved without sacrificing ease of operation during both installation and removal. The ease of operation is accomplished by means of the overall design of the attachment and the design of individual features. A feature that contributes greatly to the ease of operation is the circumferential spacing of the retaining devices from each other and from the hooks.

Although the preferred embodiments of the invention have been illustrated and described herein, it is intended to be understood by those skilled in the art that various modifications and omissions in form and detail may be made without departing from the spirit and scope of the invention as defined by the following claims.

What is claimed is:

1. An attachment for a basketball hoop comprising:

a ring;

a plurality of circumferentially spaced hooks carried by and extending upwardly from said ring and positioned to hook over the hoop;

a plurality of retaining devices carried by said ring and circumferentially spaced from each other and from said hooks; each said device having an engagement surface that is biased into a position in which it engages a lower portion of the hoop, when said hooks are positioned over the hoop, to urge the hoop upwardly into firm engagement with said hooks and resist upward and rotational movement of said ring relative to the hoop.

2. The attachment of claim 1, further comprising a net attached to and hanging downwardly from said ring.

3. The attachment of claim 1, in which each said retaining device comprises a latch member having an inner end portion pivotally attached to said ring, and an outer end portion that includes said engagement surface; said member extending substantially tangentially to said ring and being biased to pivot said outer end portion upwardly into engagement with said lower portion of the hoop.

4. The attachment of claim 3, in which said outer end portion of said latch member curves downwardly and radially to form a cradle that engages said lower portion of the hoop.

5. The attachment of claim 3, in which each said retaining device comprises a torsion spring secured to said ring, and said latch member is formed by an integral continuation of said spring.

6. The attachment of claim 5, in which said outer end portion of said latch member curves downwardly and radially to form a cradle that engages said lower portion of the hoop.

7. The attachment of claim 1, in which said hooks include a pivotal hook having an upper end portion, and a lower end portion pivotally mounted on said ring to permit said upper end portion to pivot radially inwardly relative to said ring.

8. The attachment of claim 3, in which said hooks include a pivotal hook having an upper end portion, and a lower end portion pivotally mounted on said ring to permit said upper end portion to pivot radially inwardly relative to said ring.

9. The attachment of claim 4, in which said hooks include a pivotal hook having an upper end portion, and a lower end portion pivotally mounted on said ring to permit said upper end portion to pivot radially inwardly relative to said ring.

10. The combination of the attachment of claim 8, and an elongated pole having an actuating end and an opposite handle end; wherein said attachment comprises a housing which is pivotally mounted on said ring and to which said pivotal hook is attached, said housing defining a socket shaped to receive said actuating end to enable an operator grasping said handle end to remotely pivot said pivotal hook.

11. The combination of claim 10, in which said outer end portion of said latch member curves downwardly and radially to form a cradle that engages said lower portion of the hoop.

12. The combination of the attachment of claim 7, and an elongated pole having an actuating end and an opposite handle end; wherein said attachment comprises a housing which is pivotally mounted on said ring and to which said pivotal hook is attached, said housing defining a socket shaped to receive said actuating end to enable an operator grasping said handle end to remotely pivot said pivotal hook.

13. The combination of claim 12, further comprising a net attached to and hanging downwardly from said ring.

14. The attachment of claim 1, in which each said retaining device includes a flexible portion that is bendable in a radially inward direction and biased radially outwardly to urge said engagement surface against the hoop.

15. The attachment of claim 14, in which said hoop has a rounded cross section; said flexible portion comprises a flat spring having a lower end portion secured to said ring, and an upper end portion; and each said retaining device includes an engagement portion carried by said upper end portion and having formed thereon said engagement surface, said surface being rounded to conform to said cross section.

16. The combination of the attachment of claim 15, and an elongated pole having a handle end and an opposite actuating end; said actuating end having a plurality of fingers positioned to contact said engagement portions of said retaining devices to bend said retaining devices out of engagement with the hoop.

17. The combination of the attachment of claim 14, and an elongated pole having a handle end and an opposite actuating end; said actuating end having a plurality of fingers positioned to contact said retaining devices to bend said retaining devices out of engagement with the hoop.

* * * * *